United States Patent [19]

Takemoto et al.

[11] Patent Number: 4,812,361

[45] Date of Patent: Mar. 14, 1989

[54] ACRYLIC FIBER HAVING Y-TYPE SECTION AND PROCESS FOR PRODUCING THE SAME

[75] Inventors: Fumio Takemoto; Tuneo Kunishige; Mitsutoshi Ochi, all of Otake, Japan

[73] Assignee: Mitsubishi Rayon Co., Ltd., Tokyo, Japan

[21] Appl. No.: 800,158

[22] Filed: Nov. 20, 1985

Related U.S. Application Data

[63] Continuation-in-part of Ser. No. 796,071, Nov. 8, 1985, abandoned.

[30] Foreign Application Priority Data

Nov. 21, 1984 [JP] Japan ..... 59-246722

[51] Int. Cl.[4] ..... D02G 3/00

[52] U.S. Cl. ..... 428/397; 428/392; 428/394; 264/177.1; 264/177.13

[58] Field of Search ..... 428/397, 394, 392; 264/177.1, 177.13

[56] References Cited

U.S. PATENT DOCUMENTS

| | | | |
|---|---|---|---|
| 3,340,571 | 9/1967 | Bishop et al. | 264/177 F |
| 3,457,341 | 7/1969 | Duncan et al. | 264/177.13 |
| 4,091,065 | 5/1978 | Shah | 264/177.13 |
| 4,311,761 | 1/1982 | Kanbara et al. | 428/397 |

FOREIGN PATENT DOCUMENTS

| | | | |
|---|---|---|---|
| 722544 | 11/1965 | Canada | 264/177 F |
| 14731 | 2/1974 | Japan | 264/177.13 |
| 2167997 | 6/1986 | United Kingdom | 428/399 |

OTHER PUBLICATIONS

Toyobo, Co., Ltd.; Chemical Abstracts 94:4884e (1981) of Japanese Patent 80: 103311.

Teijin Ltd.; Chemical Abstracts 96:21261h (1982) of Japanese Patent 80:33945.

Matsui, K., Chemical Abstracts 92:182473m (1980), of Japanese Patent 80:16906.

*Primary Examiner*—Sharon A. Gibson

*Attorney, Agent, or Firm*—Oblon, Fisher, Spivak, McClelland & Maier

[57] ABSTRACT

The present invention relates to acrylic fibers each having a Y-type cross section which consist of an acrylic polymer constituted of at least 50% by weight of acrylonitrile, characterized in that the Y-type cross section is constructed substantially of three rectangles and when the thickness values of the middle part, innermost part, and outermost part of each component rectangle are represented by $d_0$, $d_1$, and $d_2$, respectively, the ratios of $d_1/d_0$ and $d_2/d_0$ are each in the range of 0.95 to 1.05, and a process for producing the same comprising discharging an organic solvent solution which contains an acrylic polymer constituted of at least 50% by weight of acrylonitrile, dissolved at a concentration of 22 to 30% by weight, and has a viscosity of 200 to 500 poises, through spinneret holes each having a Y-type cross section constructed substantially of three rectangles, into a coagulating liuqid composed of an organic solvent and water at a spinning draft of 1.1 to 1.8, and subjecting the thus spun filaments to washing and stretching. The acrylic fibers of the present invention have excellent bulkiness and softness to the touch.

1 Claim, 3 Drawing Sheets

FIG. 7A
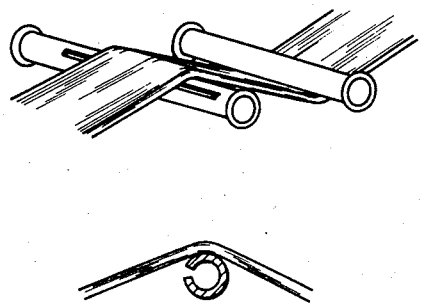
FIG. 7B
FIG. 10
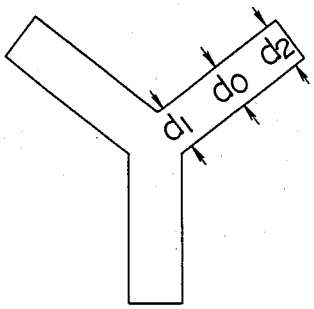

x 350 x 350

ACRYLIC FIBER HAVING Y-TYPE SECTION AND PROCESS FOR PRODUCING THE SAME

RELATED APPLICATION

This application is a continuation-in-part of Ser. No. 796,071, filed Nov. 8, 1985, now abandoned.

BACKGROUND OF THE INVENTION

1. Field of the Invention

The present invention relates to acrylic fibers excellent in bulkiness and soft to the touch which are fitted for home furnishings and apparel and to a process for producing such acrylic fibers.

2. Discussion of the Background

In general, natural fur is provided with upright fibers each attenuated at the portion nearest to the root and at the tip portion, hence having a soft characteristic feel effect relatively to the average thickness of the fiber. On the other hand, a variety of man-made fur-like fabrics produced by using synthetic fibers have so far been on the market. However, since the used synthetic fibers of these products have each a uniform thickness throughout the length thereof, these products will have a rough and hard feel even if the used synthetic fibers are made equal in fineness to the fibers of natural fur. Thus, man-made fur-like products at present are not comparable at all in feeling to natural fur. There are proposed two methods (Japanese Patent Kokai (Laid Open Publn.) Nos. 16906/80 and 134272/81) as attempts to offset the above drawback of the fur-like products. One of the methods comprises preparing a fabric by using synthetic fibers, particularly polyester fibers, as pile, and immersing the tip portions of the pile fibers in an aqueous alkali solution to hydrolyze and attenuate the tip portions. The other method comprises immersing one-end portions of fiber bundles in a hydrolytic aqueous solution to sharpen the end portions.

Because of the immersion treatments with aqueous solutions of chemicals, both the methods have industrial problems in that the degree of attenuating the tip portions of the upright fibers is difficult to control, batchwise operations of the treatments are obliged, and the efficiency of the treatments is low. Application of the above methods to acrylic fibers is also in such a situation that limited solvents can be used industrially with ease and the recovery of the used solvents is difficult.

As regards the prior art relating to fibers having Y-type special cross sections, various shapes of fibers are proposed in documents, e.g. Japanese Patent Kokai (Laid-Open Publn.) No. 103311/80, but these fibers are unsatisfactory for achieving objects of the present invention.

SUMMARY OF THE INVENTION

An object of the present invention is to provide acrylic fibers having a novel cross-sectional structure near to that of animal hair.

Another object of the invention is to provide a process for producing such acrylic fibers.

According to the invention, there are provided acrylic fibers each having a Y-type cross section which consist of an acrylic polymer constituted of at least 50% by weight of acrylonitrile, characterized in that the Y-type cross section is constructed substantially of three rectangles and when the thickness values of the middle part, innermost part, and the outermost part of each component rectangle are represented by $d_0$, $d_1$, and $d_2$, respectively, the ratios of $d_1/d_0$ and $d_2/d_0$ are each in the range of 0.95 to 1.05, and there are also provided a process for producing such acrylic fibers.

BRIEF DESCRIPTION OF THE DRAWINGS

FIGS. 7 A,B show an example of the suction device constructed of guide rolls, which will be described later.

FIG. 10 is a cross-sectional view showing positions for the thicknesses $d_0$, $d_1$, and $d_2$ of a branch constructing a Y-type cross section of an acrylic fiber of the invention.

DETAILED DESCRIPTION OF THE INVENTION

The acrylic polymer used in the present invention is preferably a copolymer of 50 to 98% by weight of acrylonitrile and 50 to 2% by weight of another unsaturated monomer copolymerizable with acrylonitrile. Such monomers include, e.g. acrylic acid, methacrylic acid, derivatives of these acids, vinyl acetate, acrylamide, methacrylamide, vinylidene chloride, vinyl chloride, and ionic unsaturated monomers such as sodium vinylbenzenesulfonate and sodium methallylsulfonate. However, the unsaturated monomer used herein is not limited to these examples.

The solvent used for wet-spinning the acrylic polymer needs to be an organic solvent such as dimethylformamide, dimethylacetamide, dimethylsulfoxide, or the like. That is because it is difficult with a solvent such as nitric acid or an inorganic salt to obtain the fiber cross section having a sharp outline consisting of straight lines.

The viscosity of the spinning feed solution is desirably from 200 to 500 poises at 50° C., as adopted for producing usual acrylic fibers, and the concentration of the feed solution is in the industrially suited range of desirability 22 to 30%, preferably 24 to 28%, by weight.

Holes in the spinneret used for producing the acrylic fibers of the present invention have Y-type cross sections each constructed substantially of three rectangles. While the dimensions of the hole may be suitably chosen depending on the intented fiber denier, it is important that the longer side and shorter side of at least one of the three rectangles constructing the Y-type section be 0.165 to 0.30 mm long and 0.043 to 0.09 mm long, respectively and the length ratio of the former side to the latter be at least 3:1, and preferably not more than 6:1, in consideration of the restriction of the spinneret hole fabrication technique and the stability of feed solution discharge. If any of the above values is less than the lower limit, the fibers having the intended Y-type cross sections will be difficult to obtain, and if any of the values exceeds the upper limit to a great extent, filament break will be liable to occur and hence no stable spinning will be possible.

Figure 4A:
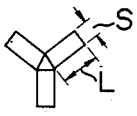
FIGS. 4 A,B show cross-sectional views or spinneret nozzles used in the process of the invention, wherein 4A is an example of the spinneret holes and 4B is an example of the preferred arrangements of spinneret holes.
Figure 4B:
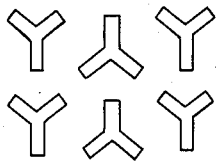

Aggregate of the filaments spun through these holes, in general, tends to carry large amounts of water on account of the shape of the filament cross section. For the purpose of inhibiting this tendency, it is desirable that the spinneret holes aligned in vertical rows be turned upside down, i.e. 180 degree, in every other row as shown in FIG. 4B.

Among the spinning conditions, the spinning draft is particularly important. During the wet spinning of an acrylonitrile-based polymer, the shapes of fiber cross sections vary with the spinning draft and the composition of the coagulating bath. In order to secure the Y-type cross section having a sharp outline consisting of straight lines, it is necessary that a coagulating liquid of the organic solvent-water system stated above be used and the spinning draft be in the range of 1.1 to 1.8. When the draft is less than 1.1, the fiber cross section will be deformed, giving none of the intended fibers of the present invention. When the draft exceeds 1.8, the intended Y-type fibers may be obtained but filament break will be liable to occur and hence no stable spinning will be possible. In the coagulating liquid, the organic solvent content is from 20 to 55%, preferably from 25 to 45%, by weight and the water content is from 45 to 80%, preferably from 55 to 75%, by weight. That is, the coagulating liquid is of a low organic solvent concentration type.

The thus obtained unstreched filaments are streched at a draw ratio of 1.5 to 7.0 while washing in hot water, and are dried. Known conditions may be applied as such to the drying.

In the process of the present invention, the amount of water carried by the spun filaments is as large as 300 to 310% by weight and therefore the filaments before drying are squeezed with guide rolls of small diameters and preferably further subjected to a suction treatment with a jointly arranged ejector, thereby reducing the amount of carried water to 250% by weight or less. These treatments are effective in lightening the load to be applied in the drying step. For this purpose, it is desirable to arrange, as shown in FIG. 7, relatively slender guide rolls of 15 to 30 mm in diameter provided with suction holes or slits.

After stretching with washing, the filaments in aggregate form are further dry-hot-stretched under tension over a 110°–150° C. heat roll at a draw ratio of 1.1 to 2.0 and then preferably subjected to relaxation treatment in a saturated steam. Thereby the intended fibers are obtained which are suited for man-made fur-like fabrics having upright pile. When the fibers, after formation of a pile-having fabric, are split at the tip by a mechanical shock, the above dry-hot-stretch is effective in improving the splitability.

As described hereinbefore, the intended acrylic fibers of the present invention are obtained, which have each a Y-type cross section constructed substantially of such three rectangles that the ratios of $d_1/d_0$ and $d_2/d_0$ are each in the range of 0.95 to 1.05, where $d_0$, $d_1$, and $d_2$ are thickness values of the middle part, innermost part, and the outermost part, respectively, of each component rectangle. These fibers in the later fabrication process are locally (at the tip portions) split to a split percentage of 15 to 50, where the resulting pile fibers keep the Y-type cross sections at the root portions. Thus the product retains high resilience and compression resistance and additionaly has a soft, flexible feel since the part of the pile fibers are split to have finer rectangular cross sections at the tip portions.

The present invention is illustrated in more detail with reference to the following examples. In all the examples, part and % are indicated by weight.

EXAMPLE 1

A copolymer constituted of 92.7% of acrylonitrile, 7.0% of vinyl acetate, and 0.3% of sodium methallylsulfonate was dissolved in dimethylformamide to prepare a spinning feed solution having a dissolved solid concentration of 24% and a viscosity of 450 poises at 50° C. This feed solution was discharged through a spinneret provided with 1000 holes each having a Y-type cross section constructed of 3 rectangles (0.16 mm×0.05 mm) at different spinning drafts of from 0.5 to 2.2 into a 30% aqueous dimethylacetamide solution at 40° C. The resulting unstretched filaments were stretched at draw ratios of 2 to 4 in hot water and simultaneously washed therewith. After application of a spinning oil, the stretched filaments were dried over a 140° C. heat roll and successively dry-hot-stretched between this roll and a 150° C. heat roll at a draw ratio of 1.5. The filaments were then treated for relaxation in saturated steam of 2.8 kg/cm$^2$ G, giving filaments having a size of 15 denier/filament, which were further stretched between 180° C. heat rolls at a draw ratio of 1.2 to be freed of crimps, and then were cut into short fibers of 152 mm in length.

Figure 1:
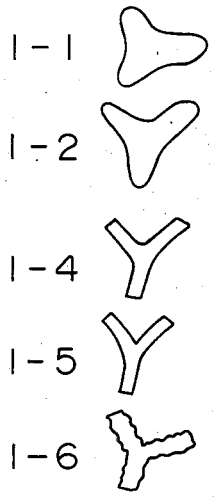
FIGS. 1 to 3 illustrate cross-sectional shapes of acrylic fibers prepared in examples according to the process of the present invention and in comparative examples.

The relation between the spinning draft and the shape of the fiber cross section is shown in Table 1 and FIG. 1.

These results indicate that the shape of the fiber cross section is of a Y-type and has a sharp outline when the spinning draft is within the range of 1.1 to 1.8. The drafts less than 1.0 cause deformation of the fiber cross section and the drafts exceeding 1.8 result in inferior spinning workability though giving fibers of cross sections having sharp outlines. Fabrics were prepared from the obtained fibers and treated in the usual way. Scanning electron microscopic observation of the surface of the fabrics indicated that the fabrics of fiber split percentages up to 5 were good in bulkiness but had coarse, hard feel, and that the fabrics of fiber split percentages 20 and higher were bulky, fairly stiff, and in addition, soft to the touch and good in feeling. Characteristics of these fabrics are shown in Table 1.

The split percentage was determined by passing sample fibers through a card five times, and observing the split degree of the fibers through a magnifying glass, followed by calculation.

Figure 8:
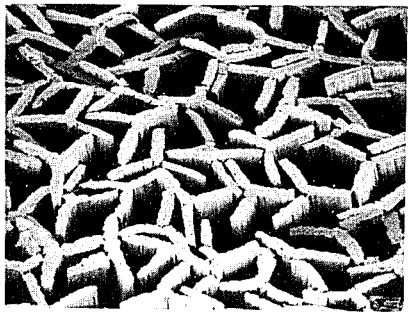
FIGS. 8 and 9 are a cross-sectional view and a side view, respectively, of fibers prepared according to the invention.
Figure 9:
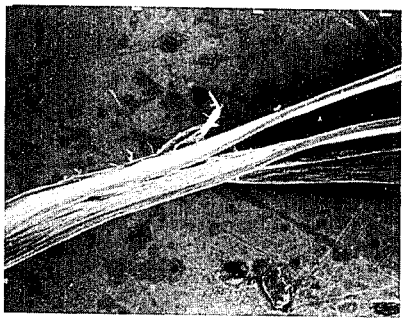

FIG. 8 is a scanning electron microscopic photograph (magnification factor 350) showing cross sections of pile fibers of Run No. 3. FIG. 9 is a scanning electron microscopic photograph (magnification factor 350) showing a side of a fiber of Run No. 3 treated to split the tip portion thereof.

TABLE 1

| Run No. | Spinning draft | Shape of fiber cross section (see FIG. 1) | $d_1/d_0$ | $d_2/d_0$ | Remarks | Characteristics of product: Split percentage | Characteristics of product: Feel |
|---|---|---|---|---|---|---|---|
| 1 | 0.5 | 1-1 | 1.33 | 0.80 | Cross-section was deformed | 0 | D |
| 2 | 0.9 | 1-2 | 1.07 | 0.75 | Cross-section was deformed | 1–5% | C–B |
| 3 | 1.1 | FIG. 8 | 1.03 | 0.98 | Present invention | 20% | A |
| 4 | 1.5 | 1-4 | 1.02 | 0.98 | Present invention | 20% | A |
| 5 | 1.8 | 1-5 | 1.02 | 0.99 | Present invention | 25% | A |
| 6 | 2.0 | 1-6 | 1.02 | 1.00 | Spinning workability was shift inferior | 40% | A |
| 7 | 2.2 | — | — | — | Spinning was impossible | — | — |

A: Good, C–B: slightly inferior, D: Inferior

EXAMPLE 2

Figure 2:
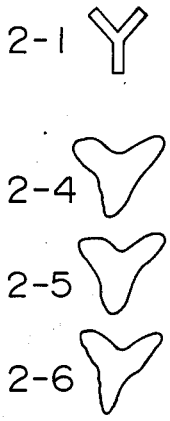

Acrylic fibers were prepared by following the procedure of Example 1 except that the spinning draft was fixed to 1.3 and the solvent in the spinning solution and in the coagulating liquid (aqueous solution of the same solvent as used in the spinning solution) were varied. The relation between the used solvent and the shape of the fiber cross section are shown in Table 2 and FIG. 2.

It is evident therefrom that organic solvents such as dimethylacetamide, dimethylformamide and the like result in Y-type fiber cross section having sharp outlines, while inorganic solvents such as nitric acid and zinc chloride result in deformed Y-type fiber cross sections.

TABLE 2

| Run No. | Solvent | Coagulating liquid | Shape of fiber cross section (see FIG. 2) | $d_1/d_0$ | $d_2/d_0$ | Note |
|---|---|---|---|---|---|---|
| 1 | Dimethylacetamide | Aqueous dimethylacetamide solution | 2-1 | 1.03 | 0.99 | Present invention |
| 2 | Dimethyl formamide | Aqueous dimethylformamide solution | " | 1.01 | 0.97 | Present invention |
| 3 | Dimethylsulfoxide | Aqueous dimethylsulfoxide solution | " | 1.01 | 1.00 | Present invention |
| 4 | Sodium thiocyanate | Aqueous sodium thiocyanate solution | 2-4 | 1.35 | 0.80 | Comparative Example |
| 5 | Nitric acid | Aqueous nitric acid solution | 2-5 | 1.28 | 0.82 | Comparative Example |
| 6 | Zinc chloride | Aqueous zinc chloride solution | 2-6 | 1.33 | 0.78 | Comparative Example |

EXAMPLE 3

A polymer with a specific viscosity of 0.180 was prepared in a yield of 80% based on the total monomer by the usual redox polymerization of 60 parts of acrylonitrile, 38 parts of vinylidene chloride, and 2 parts of sodium methallylsulfonate.

This polymer was dissolved in dimethylacetamide to prepare a spinning feed solution having a dissolved solid concentration of 26% and a viscosity of 200 poise at 50° C. This feed solution was discharged through the same spinneret as used in Example 1 into an aqueous dimethylacetamide solution, and fibers of a size of 10 denier/filament were obtained. A fur-like fabric was made from these fibers by the ordinary process. The obtained fabric was flame-retarding and bulky, fairly stiff, soft to the touch, and superior in feeling.

EXAMPLE 4

Figure 3:
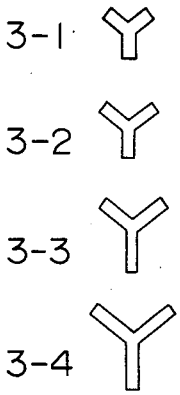
Figure 5:
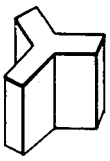
FIG. 5 is a perspective view showing a cross section of a fiber obtained aocording to the invention.
Figure 6:
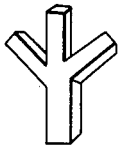
FIG. 6 is a schematic view illustrating the state of splitting a fiber tip portion by a mechanical shock after formation of a fabric from such fibers.

Fibers of a size of 15 denier/filament were prepared by following the procedure of Example 1 except that the spinning draft was fixed to 1.3 and the longer to shorter side length ratio of each of the three rectangles constructing the Y-type cross section of the spinneret hole was varied from 2:1 to 7:1. Cross-sectional shapes of the obtained fibers are shown in Table 3 and FIG. 3.

The results indicate that; when said longer to shorter side length ratio is in the range of from 2:1 to 7:1, the produced fibers show Y-type cross sections; when said ratio is in the range of from 3:1 to 5:1, the splitability also is good; when said ratio is less than 3:1, the splitability is inferior and the intended fabric is not obtainable; and when said ratio exceeds 7:1, the spinning workability is lowered through the splitability is good.

TABLE 3

| Run No. | Spinneret hole: Longer side length (L) (mm) | Spinneret hole: Shorter side length (S) (mm) | Spinneret hole: Ratio of L/S | Spinneret hole: Number of holes | Shape of fiber cross section (see FIG. 3) | $d_1/d_0$ | $d_2/d_0$ | Remarks | Split percentage % |
|---|---|---|---|---|---|---|---|---|---|
| 1 | 1.00 | 0.055 | 2:1 | 200 | 3-1 | 1.10 | 0.95 | Splitability was inferior | 10 |
| 2 | 0.165 | 0.055 | 3:1 | 200 | 3-2 | 1.02 | 0.99 | Present invention | 20 |
| 3 | 0.215 | 0.043 | 5:1 | 200 | 3-3 | 1.00 | 0.98 | Present invention | 25 |
| 4 | 0.266 | 0.038 | 7:1 | 200 | 3-4 | — | — | Spinning workability slightly was inferior | 40 |

As illustrated above, acrylic fibers provided by the present is useful for man-made fur.

EXAMPLE 5

Acrylic fibers were prepared by following the procedure of Example 1 except that the spinning draft was fixed to 1.3 and there was attached a suction apparatus having guides of 20 mm provided with liquid-removing suction slits prior to the introduction of the stretched and washed filaments in aggregate form to a drying step, whereby water carried by the filaments bundle can be removed. In this time, water contents carried by the filaments are shown in Table 4.

The filaments bundle is squeezed by means of the bar guides provided with the liquid-removing suction slits to lower water contents carried by the filaments, and therefore this process is effective for decreasing a load of the drying step.

TABLE 4

| Run No. | Guides for squeezing filaments bundle | Water contents carried by the filaments (%) | Remarks |
|---|---|---|---|
| 1 | — | 295 | Comparative Example |
| 2 | slit type bar guides | 230 | Present Invention |

EXAMPLE 6

Acrylic fibers were prepared by following the procedure of Example 1 except that the spinning draft was fixed to 1.3 and there were used spinnerets wherein the spinneret holes aligned in vertical rows are turned upside down in every other row. In this time, the relation between the rows of the spinneret holes and water contents carried by the filaments are shown in Table 5.

The spinnerets wherein the spinneret holes aligned in vertical rows are turned upside down in every other row result lower contents of water carried by the filaments in comparison with the spinnerets wherein the spinneret holes aligned in vertical rows are not turned upside down in every other row, and therefore is judged effective for decreasing a load of a drying step.

TABLE 5

| Run | Rows of spinneret holes | | Water content carried by the filaments (%) | Remarks |
|---|---|---|---|---|
| 1 | The same alignment | YYY<br>YYY | 295 | Comparative Example |
| 2 | Upside-down alignment | Y Y<br>Y Y | 245 | Present Invention |

What is claimed as new desired to be secured by Letters Patent of the United States is:

1. Acrylic fibers each having a splittable Y-type cross-section which consist of an acrylic polymer constituted of at least 50% by weight of acrylonitrile, characterized in that the Y-type cross section is constructed substantially of three rectangles and when the thickness values of the middle part, innermost part, and outermost part of each component rectangle are represented by $d_0$, $d_1$, and $d_2$, respectively, the ratios of $d_1/d_0$ and $d_2/d_0$ are each in the range of 0.95 to 1.05 and the longer to shorter side length ratio of at least one of the three branch rectangles constructing the Y-type cross section is at least 3:1 and not more than 7:1.

* * * * *